United States Patent [19]

Hoffman et al.

[11] 4,373,022

[45] Feb. 8, 1983

[54] METHOD AND APPARATUS FOR PRODUCING A HIGH SPEED HIGH RESOLUTION RADIATION SENSITIVE ARTICLE AND A HIGH SPEED HIGH RESOLUTION RADIATION SENSITIVE ARTICLE

[75] Inventors: Arnold Hoffman, 6 Hagra St., Rehovot, Israel; Shmuel Engelstein, Rehovot, Israel

[73] Assignee: Arnold Hoffman, Rehovot, Israel

[21] Appl. No.: 107,559

[22] Filed: Dec. 27, 1979

[30] Foreign Application Priority Data

Dec. 28, 1978 [IL] Israel ..... 56324

[51] Int. Cl.[3] ..... G03C 1/76; G03C 3/00

[52] U.S. Cl. ..... 430/434; 430/496; 430/497; 430/502; 430/508; 430/966

[58] Field of Search ..... 430/966, 967, 502, 503, 430/434, 504, 505, 506, 508, 509, 495, 496, 497

[56] References Cited

U.S. PATENT DOCUMENTS

| | | | |
|---|---|---|---|
| 2,179,786 | 11/1939 | Hardy | 430/509 |
| 2,456,956 | 12/1948 | Knott | 430/503 |
| 2,565,378 | 8/1951 | Land . | |
| 3,418,123 | 12/1968 | Haugh | 430/966 |
| 3,457,072 | 7/1969 | Ditzer et al. | 430/509 |
| 3,637,388 | 1/1972 | Ranz et al. | 430/406 |
| 3,682,638 | 8/1972 | Kosti | 430/966 |
| 3,923,515 | 12/1975 | van Stappen | 430/966 |

FOREIGN PATENT DOCUMENTS

| | | | |
|---|---|---|---|
| 1000687 | 6/1957 | Fed. Rep. of Germany . | |
| 1017464 | 10/1957 | Fed. Rep. of Germany . | |
| 885707 | 9/1943 | France . | |
| 912277 | 12/1962 | United Kingdom | 430/967 |

*Primary Examiner*—Mary F. Downey
*Attorney, Agent, or Firm*—Browdy and Neimark

[57] ABSTRACT

A radiation sensitive article formed with large and small grains of silver halide arranged for exposure to radiation and disposed so as to permit development of the large and small grains each under independent development conditions selected to provide image wise development thereof. A method for producing a high resolution high speed photographic image and apparatus for carrying out the method are also provided.

13 Claims, 11 Drawing Figures

METHOD AND APPARATUS FOR PRODUCING A HIGH SPEED HIGH RESOLUTION RADIATION SENSITIVE ARTICLE AND A HIGH SPEED HIGH RESOLUTION RADIATION SENSITIVE ARTICLE

FIELD OF THE INVENTION

The present invention relates to films for photographic X-ray or other use having silver halide emulsion coatings and to methods for producing such films and developing them to increase their information content.

BACKGROUND OF THE INVENTION

It is well known in the photographic art that information storage in a photographic film is improved by using an emulsion having both large and small grains of silver halide. The presence of small grains enhances resolution while the presence of large grains enhances speed. A more detailed discussion of the relationship between grain size diversity and information storage is found in a book by C. E. K. Mees and T. H. James, entitled, The Theory of the Photographic Process, 3rd Edition, Macmillan Co. N.Y., 1966.

The applicant has discovered that due to the nature of the latent image development process, large and small grains require disparate development conditions. This discovery is based on applicant's theory which will be described briefly hereinbelow.

The latent image appearing on a silver-halide emulsion is the result of a thermodynamic change in the state of a silver halide grain contained in the emulsion as the result of photon absorption. More specifically stated, the redox potential of the grain $E_g$ changes in such a way that the exposed grains have a greater tendency to accept electrons than the unexposed grains.

The relationship between the redox potential of the grain, $E_g$ and the exposure may be expressed by the following equation:

$$E_g=(R\,\overline{T}/F)\ln P+\text{constant} \quad (1)$$

where P is the exposure:
R is the gas constant
$\overline{T}$ is the Absolute Temperature
F is the Faraday constant
The different tendency to accept electrons $E_g$ of different grains is expressed in the latent image during development. If one considers the corrosion model of development described, for example in A. Hoffman, et. al., Photographic Science and Engineering, Vol. 18, 1974, p. 12, there are two different sequential stages of reduction of the silver halide grain by the developer. During the first stage, there occurs a reaction, which is not limited by the surface area of the silver speck, in which developer ions $D^-$ collide with the surface of the grain and whereby electrons are transferred at a generally constant and slow rate from the developer to the grain for reduction thereof.

In the first stage of development, the kinetics are zero'th order, that is, that the rate of change over time of the silver speck resulting from reduction of the silver halide is a constant A proportional to the product of the surface area of the grain and the developer ion concentration.

During the second stage of development an autocatalytic reaction takes place in which developer ions inject electrons directly into the silver speck. This second stage is obviously dependent in its rate on the surface area of the silver speck.

Equation (1) above may be cast into the corrosion model to generate an equation which defines the duration of the first stage:

$$T=H/A\,(p'/p)^{a/b} \quad (2)$$

where
T is the duration of the first stage of development
H is a constant that is determined inter alia by the redox potential of the developer $E_D$
A is the product of the area of the silver halide grains and the the developer concentration;
p is the number of photons absorbed per grain of silver halide and a, b and p' are constants.
It follows from equation (2) that for a fogged (unexposed) grain, e.g. where p=1, T will be large and for an exposed grain where p>>1 T will be small.

The relationship between the redox potential of the developer $E_D$ and the induction period T is:

$$E_D \approx K_1 \log T+\text{Constant} \quad (3)$$

and the relationship between $E_D$ and the developer concentration
($D^-$) is:

$$E_D \approx K_2 \log D^- +\text{Constant} \quad (4)$$

where $K_1$ and $K_2$ are constants.

It can be generally stated that

T unexposed grain>T>T exposed grain where T is the residence time of the silver halide grain in the developer.

For a given development process, that is, for a given developer $E_D$ in a given concentration of $D^-$ 1. Small unexposed grains will have a small value of A and thus a relatively large T, for example, 30 seconds. Exposing the small grains will decrease T, for example to a third, or 10 seconds. Thus if the development time T is set at for example 20 seconds, the exposed grains will enter Mode II, (the auto-catalytic development process) and be developed, while the unexposed grains wll not enter Mode II and will remain undeveloped. The result is desired image-wise development.

2. Large unexposed grains will have a large value of A and thus a relatively small T, for example 3 seconds. Exposure of the large grains will decrease T in accordance with equation (1) for example to a third, or one second. In this case there is no practical development time T since a development time of 2 seconds will not allow for complete stage II development of the exposed grains and a development time in excess of 3 seconds permits development of unexposed grains resulting in non-image wise development, which is not desired.

It may thus be appreciated that the development of large grains requires a less potent development process than the development of small grains. The large grain developer must have a lower tendency to give up electrons $E^\circ_D$ for increasing H in equation (2) and a lower concentration of $D^-$ for lowering A in equation (2).

Summarizing the above discussion, it may be appreciated that large and small grains require diametrically opposed development conditions. The use of any single development process for both grain sizes involves a compromise which of necessity results in the loss of information contained in the exposed emulsion due to non-image wise development thereof. Furthermore, if the large and small grains are in intimate contact with each other, the oxidation products of the development of the large grains, which according to the above teaching, generally develop first, will interfere with development of the small grains and vice versa.

The present invention seeks to provide photographic material and techniques for increasing the information content and capacity of a photographic emulsion in accordance with the above theory.

There is thus provided in accordance with an embodiment of the present invention a radiation sensitive article formed with a population of large grains and a population of small grains of silver halide arranged for exposure to the radiation and disposed so as to permit development of the large and small grains each under independent development conditions selected to provide image wise development of each thereof giving two coincident or superimposed images.

Further in accordance with an embodiment of the present invention, the large grains may be disposed on one side of a transparent impermeable film and the small grains may be disposed on the other side of the film to permit separate development thereof to provide two superimposed images.

Additionally in accordance with an embodiment of the present invention emulsions on opposite sides of a film and having the same silver halide grain size may be treated under different conditions to produce different silver halide grain sizes.

Further in accordance with an embodiment of the invention there is provided a method for producing a high resolution high speed photographic image comprising the steps of:

preparing radiation sensitive material having relatively large and relatively small grains of silver halide;

arranging the silver halide grains so as to permit the large and small grains to encounter different development conditions;

exposing the radiation sensitive material; and developing the large grains with a relatively weak developer and developing the small grains with a relatively strong developer, so as to permit image wise development of both the large and small grains.

Further in accordance with an embodiment of the present invention the arranging step may comprise providing separate layers of large grain and small grain emulsions. Alternatively the individual grains may be separately encapsulated with materials which result in different development conditions.

BRIEF DESCRIPTION OF THE DRAWINGS

The invention will be more fully understood and appreciated from the following detailed description taken in conjunction with the drawings in which.

DETAILED DESCRIPTION OF THE INVENTION

Figure 1:
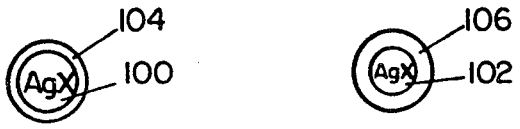
FIG. 1 is a schematic illustration of coated silver halide grains in accordance with an embodiment of the present invention.

Reference is now made to FIG. 1 which shows in schematic illustration respective large and small grains of silver halide 100 and 102 each provided with an outer encapsulating layer 104 and 106 respectively. The base material of the encapsulating layers may be gelatin. A large concentration of developer precursor may be contained in the encapsulating material, in selectable amounts and concentrations.

For example the respective encapsulating layers 104 and 106 may comprise respectively:

a. smaller and larger concentrations of the same developer precursor;

b. different developer precursors at the same concentration c. a combination of a. and b. above.

d. smaller and larger concentrations of activating materials such as $OH^-$ or pH buffer;

e. larger or smaller concentrations of development retarder such as different bromide ion concentrations, anti foggants, etc. or a degradable polymeric material which retards access of the developer to selected grains.

In the above described embodiments, the photographic material once coated may be exposed and developed in a relatively conventional manner by adding chemicals such as developer precursor or activator.

An example of a development precursor is hydroquinone or blocked hydroquinone for enhanced stability. An example of an activating material is KOH, e.g.

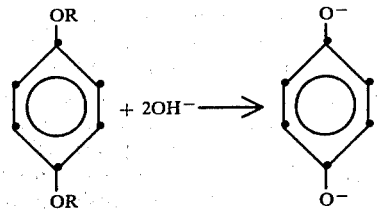

where R=H or an organic moiety such as $CO\ CH_3$ for blocking.

It is noted that throughout the specification and claims the term photographic is used in its generality and is not limited to optical sensitivity but rather refers to radiation sensitivity generally. It is also noted that the grain sizes mentioned herein, while they can vary generally over a large range, for example:

large grains 0.9–2.0 microns small grains 0.1–0.9 microns are essentially relative. For the purposes of definition herein a large grain relative to a small grain is larger by at least ten percent. In a preferred embodiment, the difference between the two should be not more than four stops in speed.

Thus, for example, a combination of a 0.2 micron grains and 0.3 micron grains would be considered in accordance with the above teaching as a combination of small and large grains as would also a combination of 1.0 micron and 1.1 micron grains.

Figure 2:
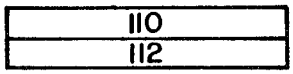
FIG. 2 is a schematic illustration of layers of large and small grains of silver halide arranged in back to back arrangement.

Referring now to FIG. 2 there is seen radiation sensitive material comprising separate first and second layers 110 and 112. Layer 110 comprises relative large grains dispersed in gelatin modified to contain one of the materials a–e mentioned hereinabove in connection with FIG. 1 designed to provide an optimum developing environment for the large grains. The gelatin may or may not be chemically bonded to these materials. Layer 112 similarly comprises relatively small grains dispersed in an emulsion of gelatin and containing one of the materials a–e mentioned hereinabove designed to provide an optimum developing environment for the small grains.

Figure 3:
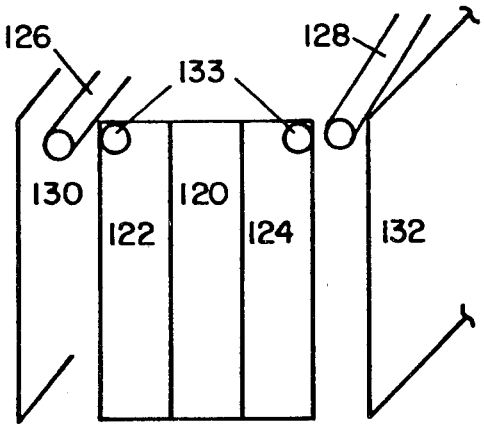
FIG. 3 is a schematic illustration of a developing arrangement constructed and operative in accordance with an embodiment of the present invention.

Referring now to FIG. 3 there is seen radiation sensitive material constructed and operative in accordance with an alternative embodiment of the present invention in which a barrier substrate or film 120 is coated on respective opposite sides with respective large grains and small grains in identical gelatin matrices 122 and 124. The radiation sensitive material is then exposed and each side thereof is developed independently of the other under conditions suitable to image wise development of the particular grain size. This development may be with the aid of brushes 126 and 128 which may be wetted with reagents such as developer and which may contact sheets 130 and 132 which contain development controlling chemicals. Alternatively pods 133 which may be disposed on the film may be broken by contact with rollers or spreaders on each side of the film prior to contact between the roller or spreader and the film surface. The pods 133 may contain different developer compositions.

Alternatively, the quantity of silver halide crystals and/or the type of gelatin is dispersed in different amounts on each side, so that even if the two sides each with a different grain size are subjected to the same developer, different concentrations of reactants result, such that the optimum conditions for development of each side obtain. This material, after exposure, can then be processed by conventional automatic processing machines.

The adjustment is such that if the grain size between the large and small grains differs by 10% to 5000%, the concentrations of identical developer, according to this teaching should change by 10% to 5000%, compensated for changes in the redox potential of the developer, $E_D$, with concentration and its effect on the change in induction period, T. That is, equations 2, 3 and 4 above have to be adjusted so that induction periods of large and small grains are comparable.

Figure 4:
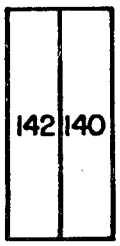
FIG. 4 is a schematic illustration of radiation sensitive material constructed and operative in accordance with an embodiment of the invention.

Referring now to FIG. 4, there is seen radiation sensitive material which comprises two substrates 140 and 142 each of which is coated with a different size grain emulsion. The two substrates are exposed together and are separated for separate development according to their grain size. After development, the two substrates may be joined permanently in alignment to form a negative.

It is a particular feature of the present invention that by the use of a combination of relatively large grains and relatively small grains, a high speed high resolution photographic image may be produced, having a high information content due to the image wise development of each grain size in accordance with the above theory of the applicant.

Experimental results will now be presented as examples.

EXAMPLE I

Three different samples were exposed to tungsten lamp illumination through a variable density step wedge, each step corresponding to ½ of a stop.

Control 1: AGFA CURIX RP-2 developed in D-19 at 20° C. for 6 minutes.

Control 2: A sandwich of two of the above (Control 1) films developed in D-19 at 20° C. for 6 minutes.

(Note the AGFA CURIX RP 2 is a film coated on both sides with a coarse grain emulsion.)

TEST: A sandwich of AGFA CURIX RP-2 film and Kodak Plus X film, one sheet of each. The RP-2 was developed in D-19 at 20° C. for 6 minutes and the Plus X was developed in D-76 at 20° C. for 5½ minutes.

The sandwich was arranged such that the incident radiation first passed the wedge, then the RP-2 and then the Plus X.

RESULTS

Speed/Latitude

Latitude is defined as the exposure range over which the film shows gradations of density.

Positive prints of the three samples were printed at different light levels in order to optimally expose the different sections of the step wedge. The Test has higher density than either control 1 or control 2. (There is less density (darkness) on the positive print which represents more density in the original negative. The density of the original negative is of interest here)

The Test has higher density than either control 1 or control 2.

Step 6 is the lowest step that the eye can differentiate in the Test and in control 1 as compared with step 7 in control 2. That is, in control 2 the eye cannot differentiate between steps 6 and 7 whereas in the Test and in control 1, the eye can differentiate between steps 6 and 7.

The prints of this example show that the latitude of the Test sample is greater than that of control 2 and the density of the Test sample is greater than that of control 1. The absolute density of the steps at the high exposure levels is greater in control 2 than in the Test sample. However, since the useful information in the negative is indicated by the density relative to fog, an H–D curve was plotted to measure density relative to fog. This curve is illustrated in FIG. 5.

Figure 5:
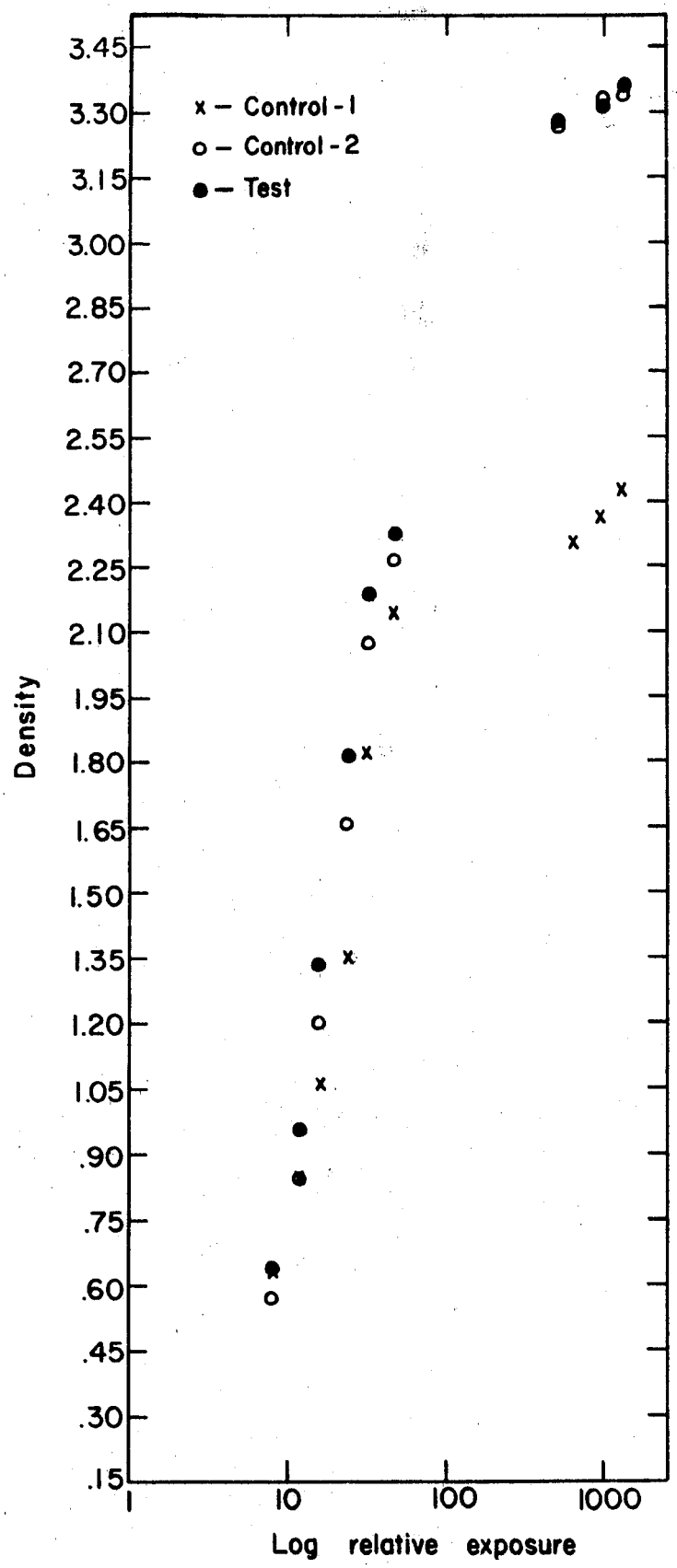
FIG. 5 is a H-D curve illustrating test results of Example I.

FIG. 5 shows a plot of Density versus log relative exposure, otherwise known as an H–D curve, for the Test, control 1 and control 2 over an operative range. In each case, the densitometer used to produce these measurements was zeroed onto the fog level of the corresponding emulsion being measured. It can be seen from FIG. 5 that the Test sample gives greater density relative to its fog level at every exposure, than either control 1 or control 2. This means that the Test sample has more speed than either control.

Resolution

The resolution of control 1 and the Test sample were visually compared and were found to be approximately the same and much superior to the resolution of control 2.

EXAMPLE II

An X-ray exposure (15 Kv, 10 mA, 0.5 minutes) of varying intensity was arranged by using overlapping aluminum discs of various thicknesses, 0.1 mm, 0.3 mm and 0.4 mm to generate four levels of exposure, b, c, d and e relative to a full exposure level a. where the thicknesses of aluminum between the X-ray source and the film were as follows:

a. zero
b. 0.1 mm
c. 0.4 mm
d. 0.3 mm
e. 0.7 mm control 1: AGFA CURIX RP-2 developed in D-19 at 20° C. for 6 minutes control 2: A sandwich of 2 AGFA CURIX RP-2 film developed at 20° C. for 6 minutes.

Test: A sandwich made up of AGFA CURIX RP-2 and Kodak Ektapan film.

The RP-2 was developed in D-19 at 20° C. for 6 minutes and the Ektapan was developed in HC 110 at 20° for eight minutes.

The Kodak Ektapan is a fine grain emulsion; (a few tenths of a micron grain size with a relatively large spread in grain size). The RP-2 is a coarse grain emulsion; about one micron grain size with a relatively narrow spread in grain size.

The Test sandwich was arranged such that the X-rays first passed through the aluminum disks, then through the RP-2 and then reached the Ektapan.

A copper screen was also placed between the X-ray source and the control 1, control 2 and Test samples.

RESULTS

Speed/Latitude

A positive print of the three samples exposed behind the various combinations of aluminum disks was made in terms of speed and latitude, the Test sample is superior to both control 1 and control 2. Although every step in control 2 is darker than the Test and control 1 corresponding steps, control 2 has little latitude. The Test sample has more latitude than either control 1 or control 2.

Positive prints of the Test, control 1 and control 2 samples respectively were made under the above test conditions and in which a copper screen was placed between the X-ray source and the film samples. The resolution of the Test sample is better than that of control 1 and much better than that of control 2.

Figure 6:
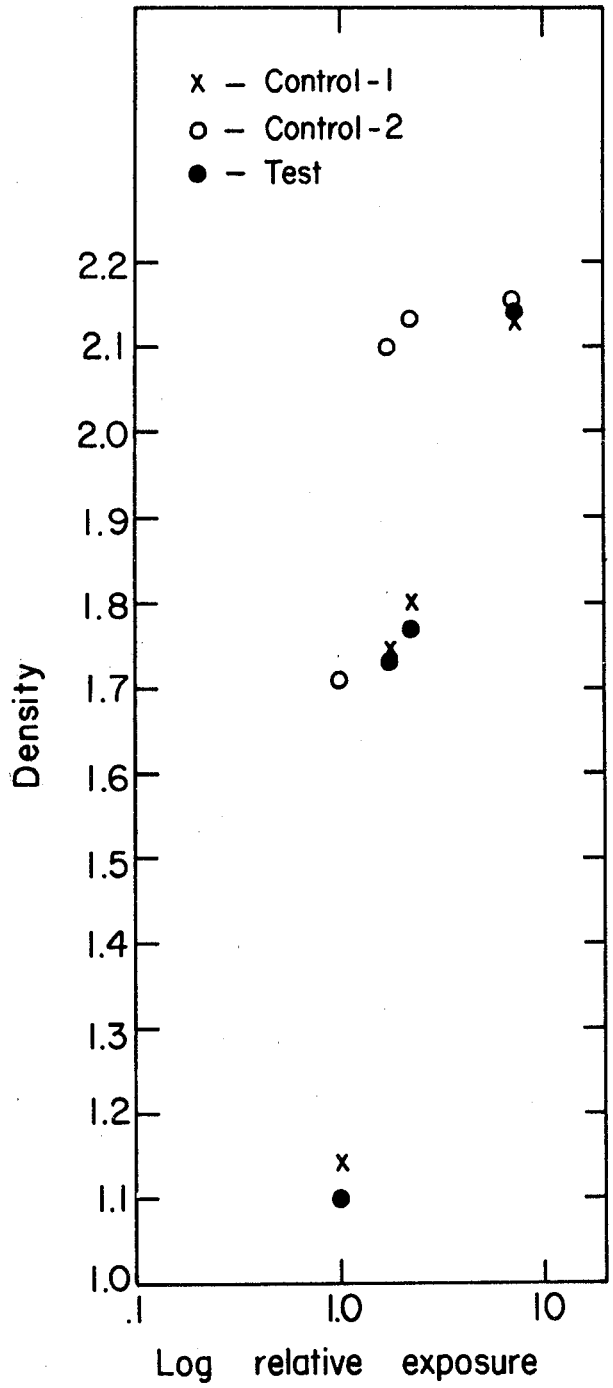
FIG. 6 is an H-D curve illustrating test results of Example II.

Reference is now made to FIG. 6 is a H–D curve, i.e. a plot of Density versus log relative exposure for the control 1, control 2 and Test samples. In each case the densiometer used to produce the measurements was zeroed on the fog level of the respective emulsion being measured. The results indicate that the Test sample has greater latitude than either of the control samples.

EXAMPLE III

Four different samples were exposed to X-rays (15 KV, 10 mA, 0.5 minute). The intensity of the radiation was varied by using various thicknesses of Reynolds Wrap® Aluminum Foil, in steps of 2,4,6,8,10,12,14,16,18 and 20 thicknesses, a 0 thickness defining a fog level.

The samples were as follows:

control 1: AGFA CURIX RP-2 developed in D-19 at 20° C. for 6 minutes control 2: A sandwich of 2 AGFA CURIX RP-2 films developed in D-19 at 20° C. for 6 minutes Test 1: A sandwich of AGFA CURIX RP-2 and Kodak Ektapan. The RP-2 was developed in D-19 at 20° C. for 6 minutes and the Ektapan was developed in HC 110 at 20° C. for 8 minutes. The sandwich was exposed in the following order facing the X-ray source: Aluminum foil; Ektapan; RP-2

Test 2: A sandwich of AGFA CURIX RP-2 and two Kodak Ektapan films. This sandwich comprises four emulsion layers as does the control 1 sample. The sandwich was exposed in the following order facing the X-ray source: Aluminum foil, Ektapan, Ektapan, RP-2.

RESULTS

Speed/Latitude

Positive prints of the above four samples exposed at two different printing light levels were made.

The first set of prints showed that Tests 1 and 2 have more latitude than controls 1 and 2. Test 1 is overexposed relative to control 1.

The second set was printed under a longer exposure time than the first set. The steps in Test 1 are at a higher absolute density than the steps in Control 1. These results indicate a particular feature of the photographic material and techniques of the present invention, namely that notwithstanding a decrease in intensity of radiation, which may also be understood as a reduction of dosage, substantially the same information may be obtained using photographic material of the present invention.

Control 2 in the second set shows one more step than Test 2 and the steps in control 2 are more dense than in Test 2. By considering Example II it may be appreciated that the resolution of the control 2 sandwich will be much less than the resolution of the Test 2 sandwich.

Figure 7:
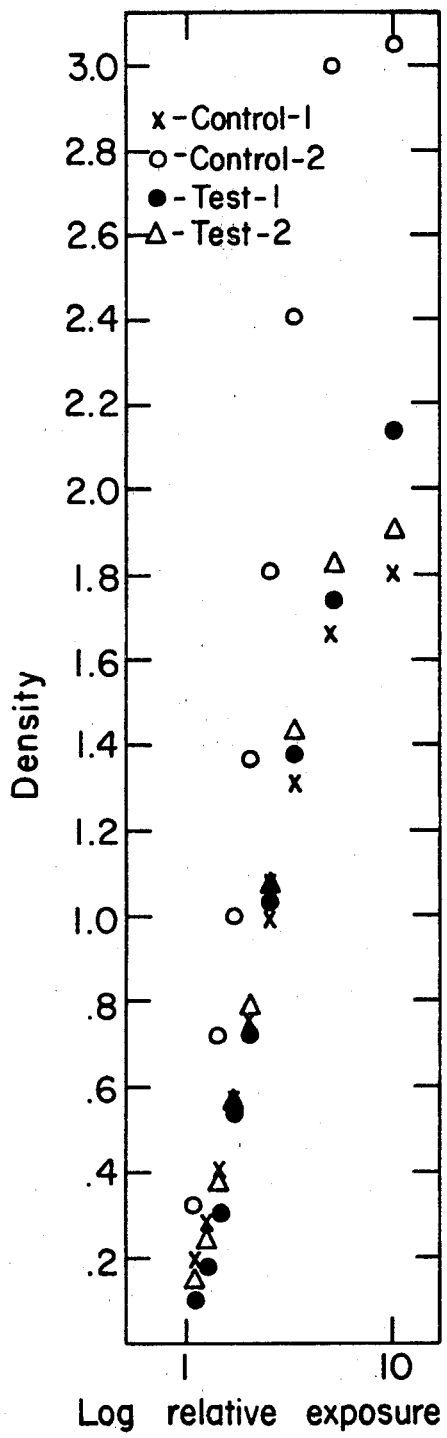
FIG. 7 is an H-D curve illustrating results of Example III.

Reference is now made to FIG. 7 which is an H-D curve, i.e. a plot of density versus log relative exposure for the four samples described hereinabove. In each case, the densitometer used to produce the measurements was zeroed on the fog level of the respective sample so that the density recorded is relative to fog. It can be seen that Test 1 has more latitude than control 1.

The following table indicates density information:

| | $Density_{min}$ (Fog Level) | $Density_{max}$ (Total Exposure) | $Density_{max}$ − $Density_{min}$ |
|---|---|---|---|
| Control 1 | 0.34 | 2.66 | 2.32 |
| Control 2 | 0.64 | 4.19* | 3.55 |
| Test 1 | 0.57 | 3.8* | 3.23 |
| Test 2 | 0.78 | 4.13* | 3.35 |

(Note that the densitometer measurements are not accurate above O.D. = 3)

The above table indicates that the slight increase in fog resulting from adding a fine grain emulsion to a coarse grain emulsion in the order of 0.23 O.D. generates an increase in $D_{Max}-D_{Min}$ of 0.91 O.D. with no sacrifice in resolution.

EXAMPLE IV

AGFA CURIX RP-2 RP 7807A control negatives having large grain emulsions on both sides thereof were exposed under the same conditions and developed differently.

Test 1: The first side was developed normally, i.e. in D-19 at 20° C. for 6 minutes.

The second side was developed in HC 110 at 20° for 8 minutes.

Control: Both sides developed normally, i.e. in D-19 at 20° C. for 6 minutes on both sides.

RESULTS

Speed/Latitude

Positive prints were made under respective greater and lesser total illumination during printing, of the two samples. The edge between steps 3 and 4 is distinguishable in the test but not in the control sample. The test negative has more density than does the control sample at step 10.

A second set of prints of test and control samples was made. The lowest step of the test sample has a higher density than the corresponding lowest step of the control sample. Thus the test has greater latitude and speed than the control.

A third set of prints of the test and control samples were made to allow visual comparison of highlights and shadows produced by the test and control samples.

Figure 8:
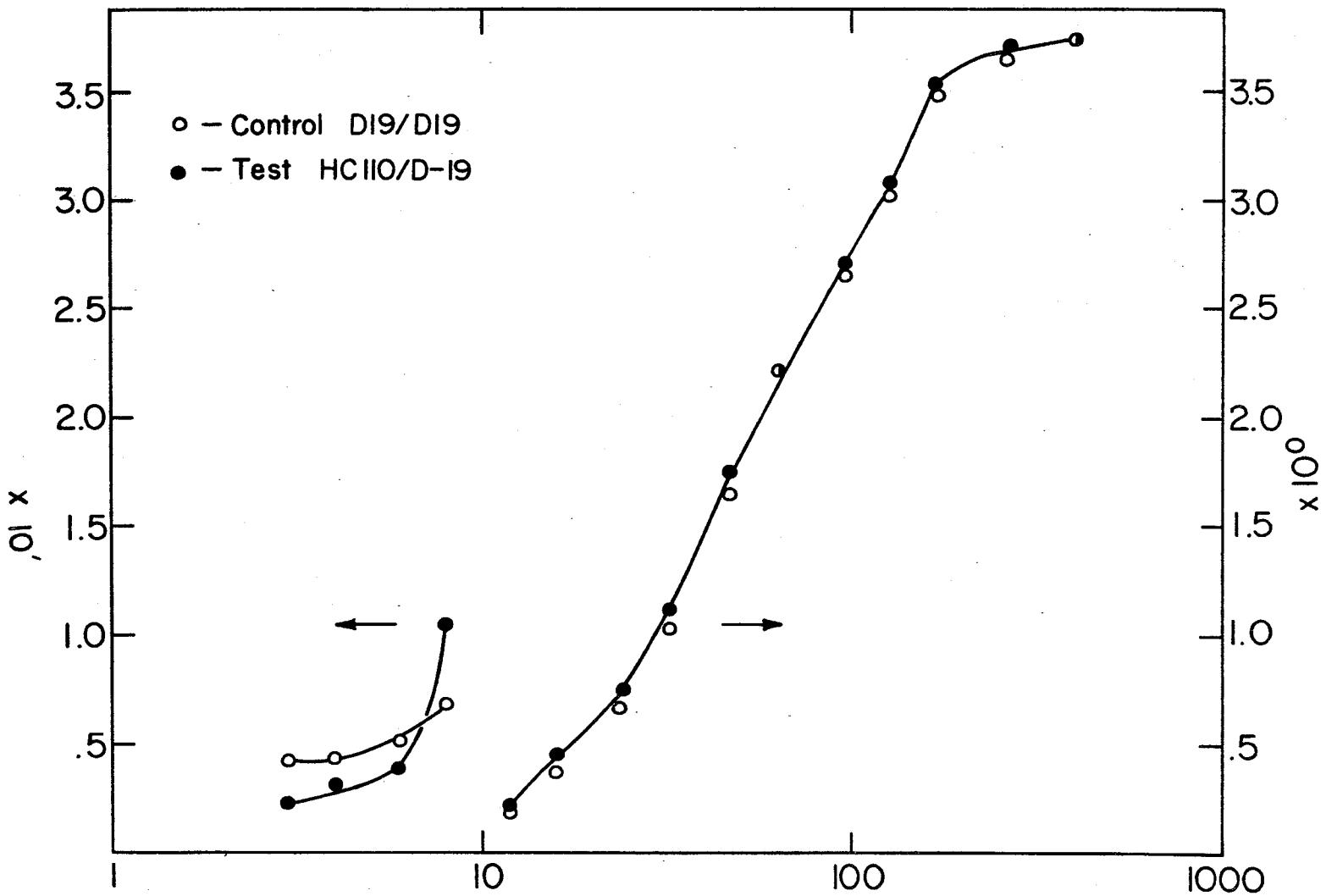
FIG. 8 is an H-D curve illustrating results of Example IV.

Reference is now made to FIG. 8 which is an H-D curve, i.e. a plot of density versus log relative exposure for the Test and control samples. The densitometer used to produce the measurements was zeroed on the fog level of the emulsion being measured. The H-D curve indicates that the test sample has more latitude and more speed than the control sample.

RESOLUTION

Each sample was exposed through a standard resolution target and exposed under the test conditions described above. A fourth set positive prints of the control and the test respectively. The resolution was measured on the actual sample at a magnification of 200 and the results were as follows:

Control 50 cycles/mm

Test 57 cycles/mm

This result was confirmed by an examination of the third set of prints which indicated that in difficult areas, the test sample is clearer than the sample. The increased speed and latitude of the test as compared with the control has already been discussed above relative to the first and second set of prints discussed above.

EXAMPLE V

Two types of samples were exposed through a step wedge to X-rays (80 KV, 50 mA for two different exposure times).

Control 1. AGFA CURIX RP 2 2 second exposure Machine developed in Kodak X-OMAT

Control 2. AGFA CURIX RP 2 1.3 second exposure Machine developed in Kodak X-OMAT Test 1. A sandwich of Kodak Ektapan film and AGFA CURIX RP-2 2 second exposure Test 2. A sandwich of Kodak Ektapan film and AGFA CURIX RP-2 2 second exposure In both tests the RP-2 was machine developed and the Ektapan was developed in HC 110 at 20° C. for 8 minutes (Dilution A).

Both Test sandwiches were arranged such that the incident radiation first passed the wedge, then the Ektapan which covered the wedge only from steps 7–13 and then the RP-2.

RESULTS

Figure 9:
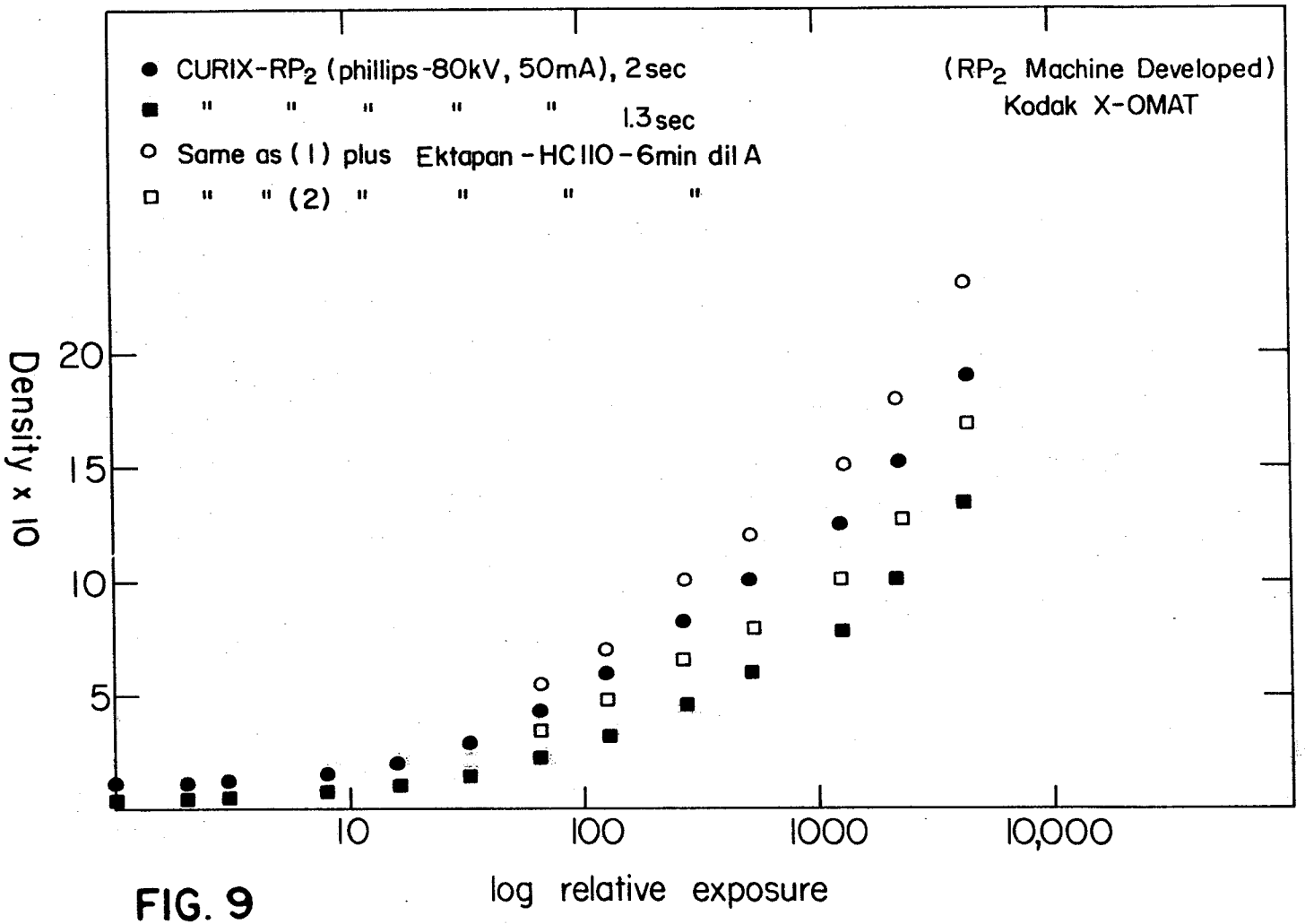
FIG. 9 is an H-D curve illustrating results of Example V.

Reference is now made to FIG. 9 which is an H-D curve; i.e. a plot of Density versus log relative exposure for the control 1, control 2 Test 1 and Test 2. In each case the densitometer used to produce the measurements was zeroed on the fog level of the respective sample, so that the density recorded is relative to fog.

It can be seen that for both exposure times, 1.3 and 2 seconds, the Test has more speed than the control. In the high exposure region the Test has one and one third more stops.

Comparing control 1, exposed for 2 seconds and Test 1, exposed for 1.3 seconds provides an estimate that the Test requires at least 20% less exposure to radiation in order to attain the same speed as the control, as suggested by Example III. Thus it is believed that the use of a Test sample could enable reduction of X-ray dosage by at least 20%.

It is important to note that with respect to all of the examples described hereinabove, the stated development conditions are believed to be optimum for the respective emulsions. Clearly, using another development process, such as a different type of developer, different concentrations, the use of additives and/or a different development time from that stated will produce an inferior result. Thus, the use of either development process for both grain sizes, i.e. the use of either development process as a common development process for both large and small grains produces poorer results than those shown in the FIGURES herein. But, as the following examples shows, some benefit can be obtained, even when the same developer is used for both grain sizes.

EXAMPLE VI

A. Two types of emulsion were exposed to tungsten lamp radiation through a variable density step wedge, each step corresponding to one-half stop.

Control 1: Large grain 1.7 micron diameter—coated on both sides of substrate at $\approx$100 mg Ag/ft$^2$ was combined with a single coat of the same large grain size emulsion to form a sandwich (double substrate) emulsion (L/L+L) comprising $\approx$300 mg Ag/ft$^2$ . After exposure, it was developed in D-19 at 20° C. for 1 minute.

Test 1: Small grain 0.8 micron diameter —coated on one side of substrate at $\approx$100 mg Ag/ft$^2$. On the other side of the substrate, the above large grain emulsion of Control 1 was coated at $\approx$100 mg Ag/ft$^2$ to form a (S/L) emulsion comprising $\approx$200 mg Ag/ft$^2$. After exposure, it was developed in D-19 at 20° C. for 1 minute.

B. A repeat of part A with the following modifications:

Control 1: Same as Control 1 in A

Test 1: A single coated small grain (identical to the small grain used in A above) coated at $\approx$100 mg Ag/ft$^2$ was combined with a single coated large grain (identical to the large grain in A above) coated at $\approx$100 mg Ag/ft$^2$ to form a sandwich emulsion (S/L) comprising $\approx$200 mg Ag/ft$^2$. After exposure all coatings were processed together in D-19 at 20° C. for 1 minute.

RESULTS

Figure 10:
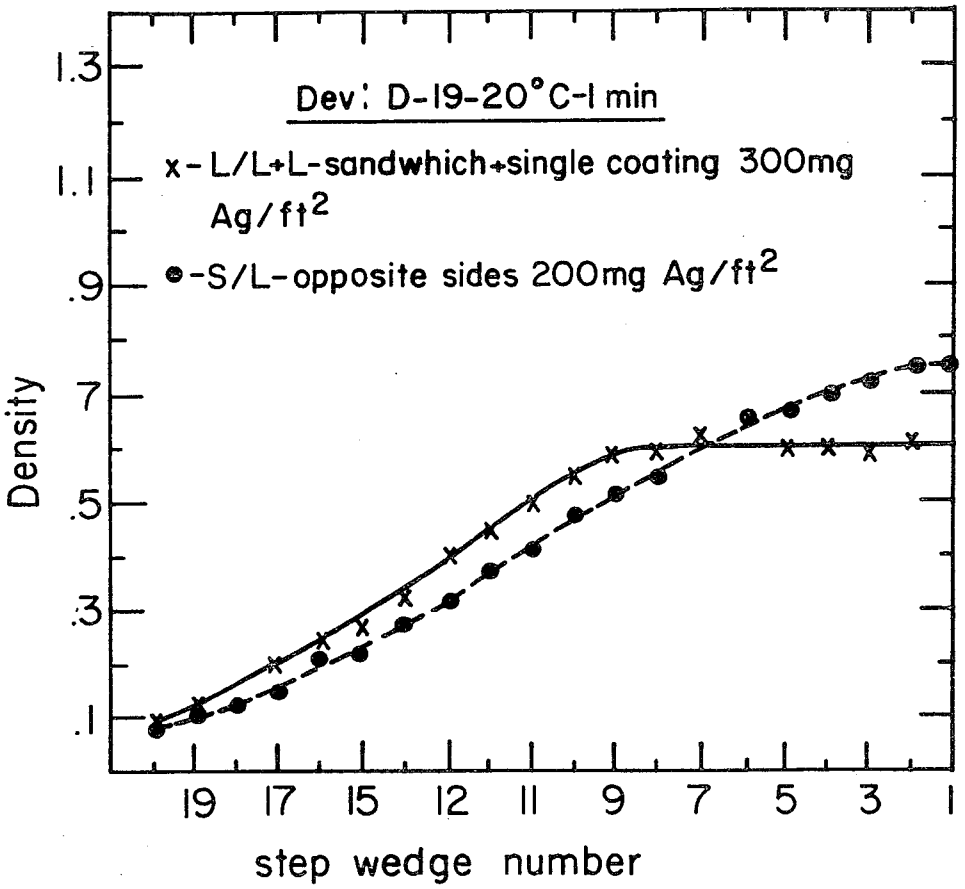
FIG. 10 is a density versus relative exposure curve illustrating results of Example VI.
Figure 11:
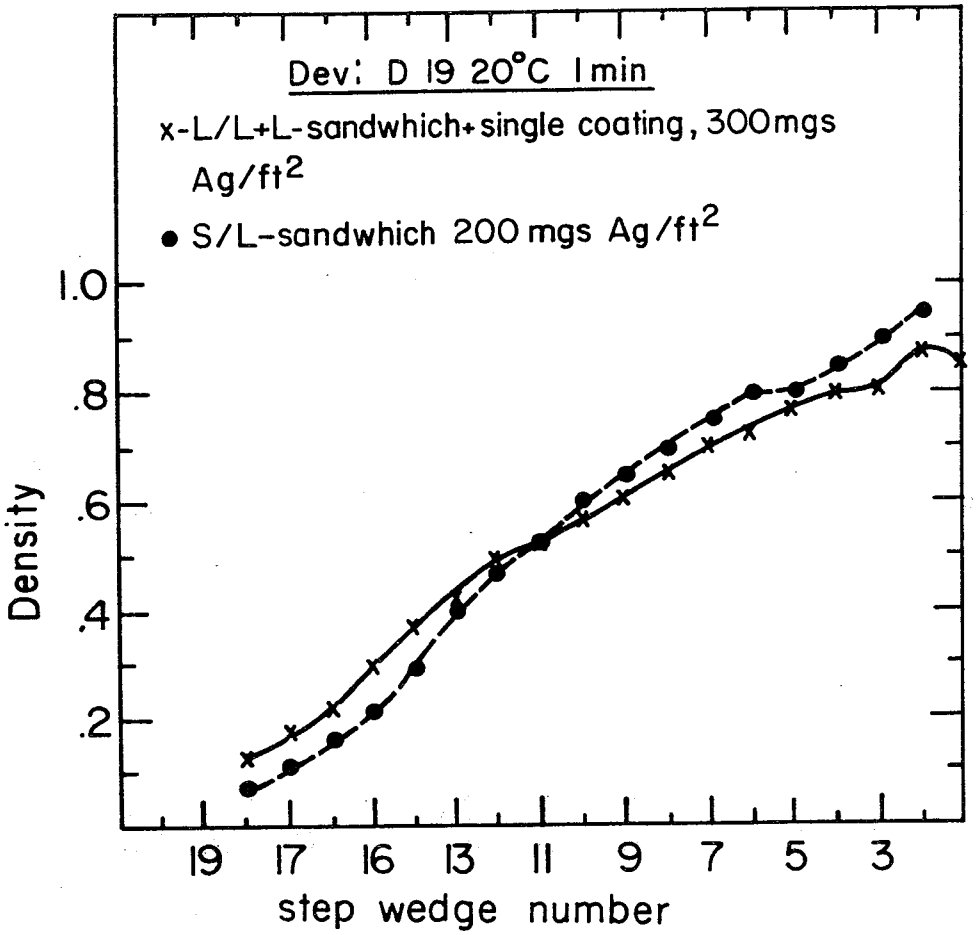
FIG. 11 is a density versus relative exposure curve illustrating results of Example VI.

FIG. 10 shows a plot of density versus step wedge number for Example VI A. FIG. 11 shows a similar plot for Example VI B. In both cases the Test, which has about 50% less silver halide is superior to the control.

IT is clear that independent development of each side does improve the photographic properties, even when this is attained by just physically separating the two emulsions on opposite sides of a substrate such that the oxidation products of one (e.g. large) grain size do not interact with the development of the other (e.g. small) grain size. This allows, for example, for machine development of both sides in conventional development machines in current and widespread use.

It will be appreciated by persons skilled in the art that the invention is not limited to what has been specifically shown and described hereinabove. Rather the scope of the present invention is defined only by the claims which follow.

We claim:

1. A method for producing a high resolution high speed photographic black and white image comprising the steps of:

preparing radiation sensitive material having relatively large and relatively small grains of silver halide;

arranging the silver halide grains so as to permit the large and small grains to be developed under independent development conditions;

exposing the radiation sensitive material; and chemically developing the large grains with one chemical developer and independently developing the small grains with another chemical developer, so as to develop both the large and small grains.

2. A method according to claim 1 and wherein the arranging step comprises providing separate layers of large grain and small grain emulsions on opposite sides of a barrier film.

3. A method according to claim 1 and wherein the arranging step comprises coating the large and small grains with coatings having different characteristics which result in different development conditions at the grains.

4. A process according to claim 1 and wherein said large grains are at least 10% larger in diameter than said small grains.

5. In a photographic negative film comprising at least one transparent impermeable support and a coating of silver halide particles on said at least one support, the improvement wherein two populations of said silver halide particles are provided, one said population comprising relatively small grains on one side of said support and another said population comprising relatively large grains on the other side of said support, the difference in the sizes of said relatively small and large grains being at least 10%, and the photographic speeds of said small and large grains differing from one another by not more than three stops;

said two populations of silver halide particles being located on said at least one support for simultaneous exposure; and said film including said impermeable support to inhibit diffusion of chemical developers therethrough, and comprising means to provide fully independent chemical development for each of said two populations of silver halide particles wherein said two populations are separated from one another by said support so as to prevent chemical developer for one said population from contacting the other said population, whereby superimposed negative images are provided.

6. In a photographic negative film comprising at least one support and a coating of silver halide particles on said at least one support, the improvement wherein two populations of said silver halide particles are provided, one said population comprising relatively small grains and another said population comprising relatively large grains, the difference in the sizes of said relatively small and large grains being at least 10%, and the photographic speeds of said small and large grains differing from one another by not more than three stops;

said two populations of silver halide particles being located on said at least one support for simultaneous exposure; and said film comprising means to provide fully independent chemical development for each of said two populations of silver halide particles wherein said two populations are separated from one another so as to prevent chemical developer for one said population from contacting the other said population, whereby coincident negative images are provided, wherein said means to provide independent development comprises an encapsulating layer for at least one of said populations, said encapsulating layer containing a development modifier selected from the group consisting of a developer precursor, a developer activating material, and a development retarder.

7. A radiation sensitive material according to claim 6 wherein the density of grains per unit area for one population is different from the density of grains per unit area in the other population so as to provide different development conditions when said sensitive material is exposed to an external developer.

8. A photographic film according to claim 6, wherein both said populations of silver halide particles are provided with encapsulating layers which differ from one another in one of the following respects:

(a) one encapsulating layer has smaller and the other encapsulating layer larger concentration of the same developer precursor;

(b) one said encapsulating layer has one developer precursor and the other has a different developer precursor at the same concentration;

(c) one encapsulating layer has a smaller concentration of a first developer precursor and the other encapsulating layer has a larger concentration of a second developer precursor;

(d) one encapsulating layer has a smaller concentration and the other encapsulating layer has a larger concentration of a development activator; and (e) one said encapsulating layer has a larger and the other encapsulating layer has a smaller concentration of a development retarder.

9. A photographic film according to claim 6 wherein said encapsulating layer includes a pH buffer.

10. A photographic film according to claim 6 wherein said encapsulating layer includes a development retarder whereby said two populations have different bromide ion concentrations.

11. A photographic film according to claim 6 wherein said encapsulating layer has a gelatin base material.

12. A photographic film according to claim 6 wherein said encapsulated grains are intermixed with one another.

13. A photographic film according to claim 6 wherein said encapsulated grains are coated on said support in separate layers.

* * * * *